US008469321B2

(12) United States Patent
Nolfi, Jr.

(10) Patent No.: US 8,469,321 B2
(45) Date of Patent: Jun. 25, 2013

(54) MASONRY UNIT WALL PIPE SUPPORT SYSTEM

(76) Inventor: Anthony F. Nolfi, Jr., Lowellville, OH (US)

( * ) Notice: Subject to any disclaimer, the term of this patent is extended or adjusted under 35 U.S.C. 154(b) by 0 days.

(21) Appl. No.: 12/980,458

(22) Filed: Dec. 29, 2010

(65) Prior Publication Data

US 2011/0168853 A1 Jul. 14, 2011

Related U.S. Application Data

(60) Provisional application No. 61/294,680, filed on Jan. 13, 2010.

(51) Int. Cl.
*F16L 3/00* (2006.01)

(52) U.S. Cl.
USPC ..... 248/73; 248/68.1; 248/71; 52/405.1; 52/596

(58) Field of Classification Search
USPC ..... 248/73, 71, 68.1; 52/596, 309.12, 52/405, 592, 593, 806, 589, 286, 436, 437, 52/438, 439, 425, 426, 309.9, 606
See application file for complete search history.

(56) References Cited

U.S. PATENT DOCUMENTS 3,885,363 A * 5/1975 Whittey ..... 52/125.3
4,306,395 A * 12/1981 Carpenter ..... 52/223.6
4,614,071 A * 9/1986 Sams et al. ..... 52/309.12
4,887,405 A * 12/1989 Nickerson ..... 52/309.12
5,062,244 A * 11/1991 Ducharme ..... 52/98
5,241,795 A * 9/1993 Giroux et al. ..... 52/503
5,349,798 A * 9/1994 Gross ..... 52/405.1
5,685,119 A * 11/1997 Zschoppe ..... 52/592.5
6,412,243 B1 * 7/2002 Sutelan ..... 52/309.7
6,889,479 B2 * 5/2005 Thorpe ..... 52/596
6,996,945 B2 * 2/2006 Doty ..... 52/585.1
7,509,779 B2 * 3/2009 Makovich ..... 52/426
7,908,799 B2 * 3/2011 Mugge et al. ..... 52/100
2005/0178081 A1 * 8/2005 Bott ..... 52/596
2007/0079566 A1 * 4/2007 Neill et al. ..... 52/284
2009/0077920 A1 * 3/2009 Korman et al. ..... 52/606
2009/0255107 A1 * 10/2009 Griffith ..... 29/464
2010/0064621 A1 * 3/2010 Steiger et al. ..... 52/596

* cited by examiner

*Primary Examiner* — Terrell McKinnon
*Assistant Examiner* — Monica Millner
(74) *Attorney, Agent, or Firm* — Calfee, Halter & Griswold LLP

(57) ABSTRACT

A masonry unit wall support system and method for supporting one or more pipes within a masonry unit wall includes a compressible support structure containing one or more holes for one or more pipes. The compressible support structure is compressively inserted into a hollow core cavity of a masonry unit to create a relatively immovable support for one or more pipes inserted through one or more holes that may be formed in the support structure either before or after the support structure is compressively inserted into the hollow core cavity.

15 Claims, 2 Drawing Sheets

MASONRY UNIT WALL PIPE SUPPORT SYSTEM

CROSS-REFERENCE TO RELATED APPLICATIONS

This application claims the benefit of U.S. Provisional Application Ser. No. 61/294,680, filed Jan. 13, 2010, the entire disclosure of which is incorporated herein by reference.

FIELD OF THE INVENTION

This invention relates to a support system and method for supporting one or more pipes for plumbing or other applications within one or more hollow core cavities of a masonry unit wall.

SUMMARY OF THE INVENTION

The support system and method of the present invention includes a support structure made out of a suitable compressible material for providing a support for one or more pipes inside a cavity of a hollow core masonry unit wall. The masonry units (blocks) may either be cement masonry units (CMU) or synthetic masonry units (SMU).

A suitable tool such as a coring tool or similar type cutting tool may be used to create one or more paths/holes through the support structure for closely receiving one or more pipes to be supported in the hollow core cavity of a masonry unit wall, with, typically (but not necessarily), a friction fit. The support structure is compressively inserted into one of the hollow core cavities in a masonry unit wall to provide a friction fit of the support structure within the cavity to create a relatively immovable support for the pipe. One or more holes may be formed in the support structure for insertion of one or more pipes through the respective holes either before or after the support structure has been compressively inserted into a masonry unit cavity.

DETAILED DESCRIPTION OF THE INVENTION

Figure 1:
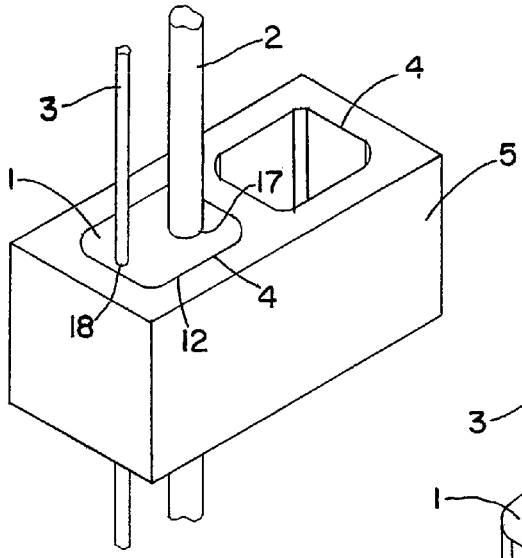
FIG. 1 is a schematic perspective view showing two pipes supported by a compressible support structure compressively inserted within a hollow core cavity of a masonry unit in accordance with the present invention.

Referring now in more detail to the drawings, and initially to FIG. 1, there is shown one form of compressible support structure 1 of the present invention being used to create a relatively immovable support for one or more pipes 2, 3 for plumbing or other applications within a hollow core cavity 4 of a masonry unit 5. The masonry units (blocks) used to make a masonry unit wall may either be cement masonry units (CMU) or synthetic masonry units (SMU) of different sizes (e.g., 6 inch, 8 inch, 10 inch and 12 inch).

Figure 3:
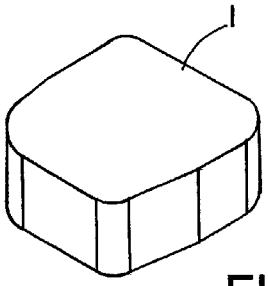
FIG. 3 is an enlarged schematic perspective view of an exemplary support structure of the present invention.
Figure 4:
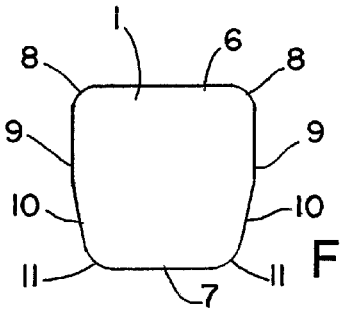
FIG. 4 is a top plan view of the support structure of FIG. 3.
Figure 5:
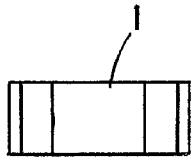
FIG. 5 is a side elevation view of the support structure of FIG. 3.

One such exemplary support structure 1 is schematically shown in FIGS. 3-5, and is desirably made of a suitable compressible polymeric material that is sufficiently compressible, (and if need be, trimable) to fit into a hollow core cavity of a masonry unit and provide sufficient holding force to create a relatively immovable pipe support. Some exemplary compressible polymeric materials from which the support structure may be made are polypropylene foam, polyurethane foam, polyethylene foam, polyester foam and expanded polystyrene.

Each support structure 1 is desirably shaped to facilitate compressively fitting the support structure into a particular hollow core cavity size, which is unique to each size of masonry unit, to provide sufficient holding force for creating a relatively immovable support for one or more pipes with no additional modifications (i.e., trimming). However, some trimming of the support structure may be performed if needed.

Figure 6:
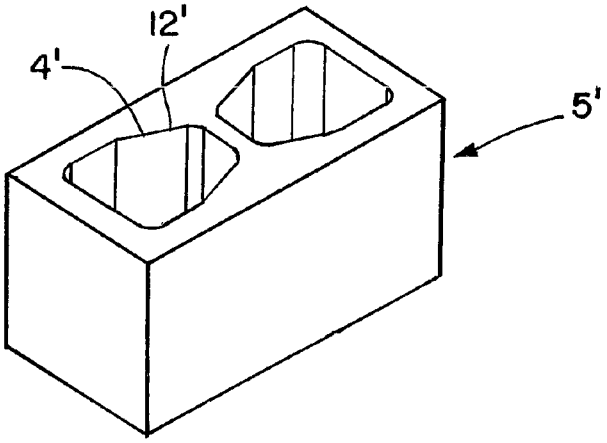
FIG. 6 is a schematic perspective view of a masonry unit having irregularly shaped hollow core cavities.

By way of example, one such support structure 1 shown in FIGS. 3-5 may have a maximum width of approximately 5½ inch, a length of approximately 5⅝ inch and a thickness of approximately 2¼ inch. Also one end 6 of the support structure may be somewhat wider than the other end 7 and may have radiused corners 8 of approximately ¾ inch radius, whereas opposite sides 9 of the support structure may have side portions 10 that taper inwardly at an angle of approximately 11° to the narrower end 7, which may have radiused corners 11 of approximately 1 inch radius. This particular shape facilitates fitting of the support structure into a hollow core cavity of an 8 inch masonry unit/block, which is approximately 5⅛ inch by approximately 6³⁄₁₆ inch, and may either have a substantially uniform profile shape 12 as shown in FIGS. 1 and 2 or an irregular profile shape 12' as shown in FIG. 6.

Figure 2:
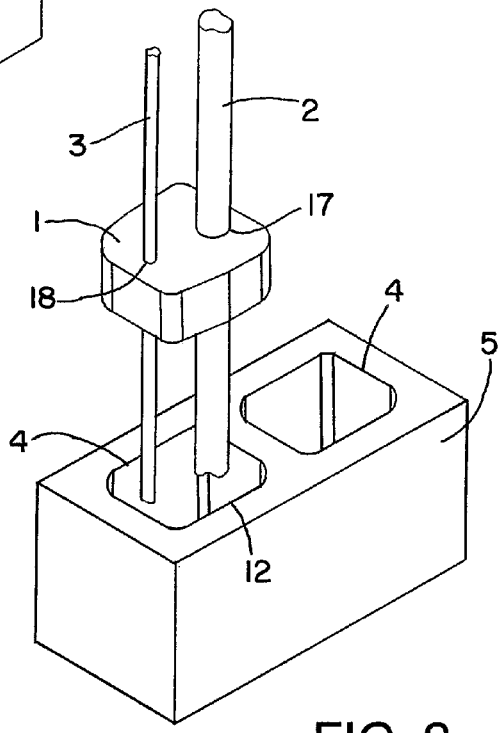
FIG. 2 is a schematic perspective view similar to FIG. 1 but showing the support structure with the pipes extending through holes therein prior to inserting the support structure into the hollow core cavity of a masonry unit.
Figure 7:
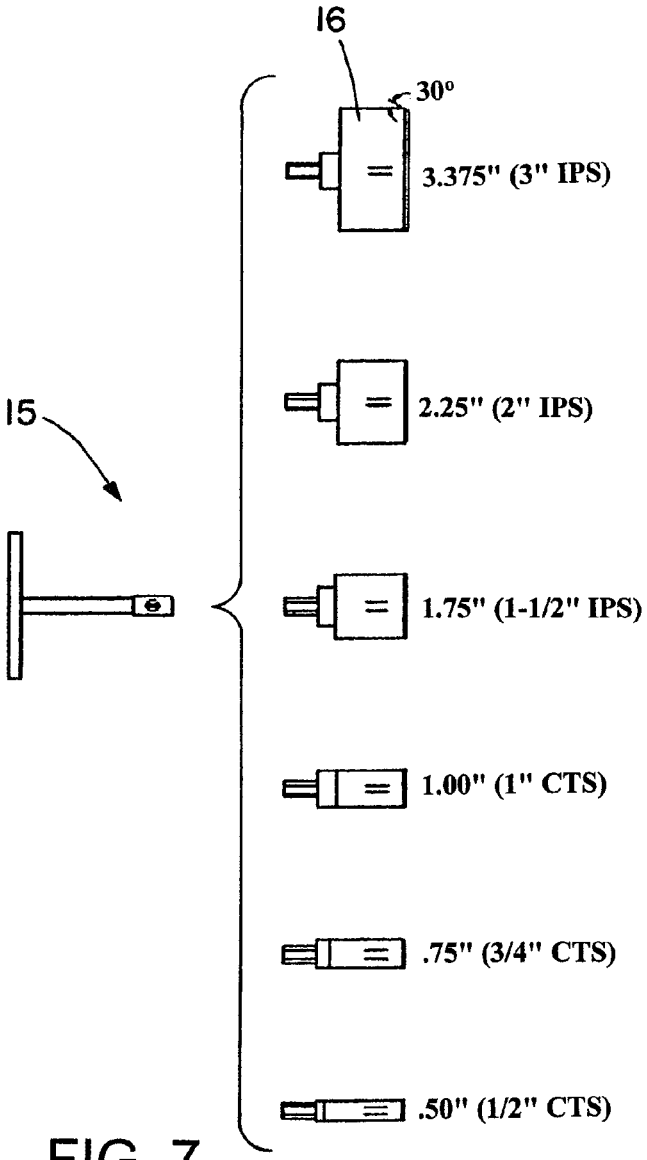
FIG. 7 is a schematic illustration of different size coring tools that may be used to form holes in the support structure compatible in size to one or more pipes to be installed in the support structure of the present invention.

A kit 15 of different size coring tools 16 such as shown in FIG. 7 may be provided for forming different size paths/holes 17, 18 through the support structure 1 compatible in size to one or more pipes 2, 3 to be installed in the support structure and the masonry unit wall (see FIGS. 1 and 2). Such holes 17, 18 are most typically formed in the support structure 1 and the pipes 2, 3 inserted through the respective holes 17, 18 before the support structure has been inserted into the hollow core cavity 4 of a masonry unit (block) 5 as schematically shown in FIG. 2. However, the support structure 1 may be installed in the hollow core cavity before the holes are cut in the support structure and the pipes are inserted therethrough if desired.

When properly installed, the support structure will provide a relatively immovable support for the pipes by using compression of the support structure material to provide a friction fit of the support structure within the hollow core cavity of a masonry unit wall. Also the support structure provides a certain degree of insulation value for the pipes and a certain degree of protection of the pipes from ultraviolet rays.

Although the invention has been shown and described with respect to a certain embodiment, it is obvious that equivalent alterations and modifications will occur to others skilled in the art upon the reading and understanding of the specification. In particular, with regard to the various functions performed by the above-described components, the terms used to describe such components are intended to correspond, unless otherwise indicated, to any component which performs the specified function of the described component (e.g., that is functionally equivalent), even though not structurally equivalent to the disclosed component which performs the function of the herein illustrated exemplary embodiment of the invention. In addition, while a particular feature of the invention may have been described with respect to only one embodiment, such feature may be combined with one or more other features as may be desired and advantageous for any given or particular application.

What is claimed is:

1. A masonry unit wall pipe support system for supporting one or more pipes within a masonry unit wall, the system comprising a compressible support structure containing one or more holes for one or more pipes, the compressible support structure being compressively inserted into a hollow core cavity of a masonry unit to provide a friction fit of the support structure within the hollow core cavity to create a relatively immovable support for the one or more pipes extending through the one or more holes in the support structure, and the one or more pipes having a friction fit in the one or more holes in the support structure to create a relatively immovable support for the one or more pipes, wherein the one or more holes has a smaller diameter than the one or more pipes extending through the respective one or more holes to provide the friction fit of the one or more pipes in the respective one or more holes.

2. The system of claim 1 wherein the support structure is made of a compressible polymeric material.

3. The system of claim 1 wherein the support structure compressively engages both an inner wall of the hollow core cavity in which the support structure is compressively inserted and an outer diameter of the one or more pipes extending through the one or more holes in the support structure.

4. A masonry unit wall pipe support system for supporting one or more pipes within a masonry unit wall, the system comprising a compressible support structure containing one or more holes for one or more pipes, the compressible support structure being compressively inserted into a hollow core cavity of a masonry unit to provide a friction fit of the support structure within the hollow core cavity to create a relatively immovable support for the one or more pipes extending through the one or more holes in the support structure, and the one or more pipes having a friction fit in the one or more holes in the support structure to create a relatively immovable support for the one or more pipes, wherein the masonry wall is comprised of a plurality of masonry units, at least some of the masonry units have compressible support structures compressively inserted into hollow core cavities of the respective masonry units, the support structures of some of the masonry units contain holes having a friction fit with larger diameter pipes than the holes through which the pipes extend, and the holes of the support structures of some of the masonry units have a different diameter than the holes in the support structures of other of the masonry units in which different diameter pipes are frictionally fitted.

5. The system of claim 4 wherein at least some of the pipes are different diameter plumbing pipes.

6. The system of claim 1 wherein the masonry wall is comprised of a plurality of masonry units, at least some of the masonry units have compressible support structures compressively inserted into hollow core cavities of the respective masonry units, at least some of the support structures contain at least one hole having a friction fit with at least one pipe extending through the at least one hole, and at least some of the holes in the support structures of some of the masonry units are at different locations than the holes in the support structures of other of the masonry units.

7. The system of claim 1 wherein the support structure has opposite ends, one of the ends being a wider end and the other end being a narrower end, and opposite sides each having side portions that taper inwardly from the wider end to the narrower end.

8. The system of claim 7 wherein the support structure has radiused corners at opposite ends.

9. The system of claim 8 wherein the radiused corners at the wider end have a smaller radius than the radiused corners at the narrower end.

10. A method of supporting one or more pipes within a masonry unit wall, the method comprising forming one or more holes through a compressible support structure, compressively inserting the compressible support structure into a hollow core cavity of a masonry unit to provide a friction fit of the support structure within the hollow core cavity, and inserting one or more pipes through the one or more holes, wherein the one or more holes that are formed in the support structure have a smaller diameter than the one or more pipes that are inserted through the respective one or more holes to provide a friction fit of the one or more pipes in the respective one or more holes.

11. The method of claim 10 wherein the support structure compressively engages both an inner wall of the hollow core cavity in which the support structure is compressively inserted and an outer diameter of the one or more pipes extending through the respective one or more holes in the support structure.

12. The method of claim 10 wherein the masonry unit wall is comprised of a plurality of masonry units, further comprising compressively inserting compressible support structures into hollow core cavities of at least some of the masonry units, forming one or more holes in the support structures of at least some of the masonry units, and inserting pipes through the holes in the support structures of at least some of the masonry units, the holes having a smaller diameter than the pipes that are inserted through the respective holes to provide a friction fit of the pipes in the respective holes.

13. The method of claim 12 wherein the holes that are formed in the support structures of some of the masonry units have a different diameter than the holes that are formed in the support structures of other of the masonry units in which pipes of a larger diameter than the respective holes are frictionally inserted.

14. The method of claim 10 wherein the masonry wall is comprised of a plurality of masonry units, further comprising forming at least some holes at different locations in the support structures of different ones of the masonry units, and inserting the same or different pipes through the holes in the support structures of different ones of the masonry units, the holes having smaller diameters than the pipes that are inserted through the respective holes to provide a friction fit of the pipes within the respective holes.

15. The method of claim 14 wherein the pipes are plumbing pipes.

* * * * *